US007028621B2

(12) United States Patent
Mercier

(10) Patent No.: US 7,028,621 B2
(45) Date of Patent: Apr. 18, 2006

(54) DEVICE FOR STORING OBJECTS

(75) Inventor: Antoine Francis Pierre Mercier, Montmorenct (FR)

(73) Assignee: Amanagement, Paris (FR)

( * ) Notice: Subject to any disclaimer, the term of this patent is extended or adjusted under 35 U.S.C. 154(b) by 0 days.

(21) Appl. No.: 10/479,321

(22) PCT Filed: May 22, 2002

(86) PCT No.: PCT/FR02/01722

§ 371 (c)(1),
(2), (4) Date: Jun. 18, 2004

(87) PCT Pub. No.: WO02/097225

PCT Pub. Date: Dec. 5, 2002

(65) Prior Publication Data

US 2005/0011423 A1 Jan. 20, 2005

(30) Foreign Application Priority Data

May 31, 2001 (FR) ..... 01 07160

(51) Int. Cl.
*E05G 1/08* (2006.01)

(52) U.S. Cl. ..... 109/56; 109/52; 70/81; 70/86; 312/107.5

(58) Field of Classification Search ..... 109/52–53, 109/56–57, 45, 47, 49–50; 70/85–87, 78–82; 312/107.5, 349–351; 211/4, 134
See application file for complete search history.

(56) References Cited

U.S. PATENT DOCUMENTS

| | | | | |
|---|---|---|---|---|
| 3,705,754 | A | 12/1972 | Drum et al. | |
| 4,341,166 | A * | 7/1982 | Cantley | 109/53 |
| 4,528,916 | A * | 7/1985 | Knight | 109/56 |
| 4,557,416 | A * | 12/1985 | Stahl et al. | 109/56 |
| 4,638,746 | A * | 1/1987 | Ishigure | 109/52 |
| 4,648,550 | A * | 3/1987 | Cleary, Jr. | 109/56 |
| 4,688,492 | A * | 8/1987 | Peghetti | 109/56 |
| 5,035,187 | A * | 7/1991 | McGunn | 109/53 |
| 5,129,501 | A * | 7/1992 | Halsey et al. | 109/52 |
| 5,219,386 | A * | 6/1993 | Kletzmaier et al. | 70/277 |
| 5,607,102 | A * | 3/1997 | Walsh et al. | 109/52 |

FOREIGN PATENT DOCUMENTS

| | | |
|---|---|---|
| DE | 411 429 | 3/1925 |
| EP | 0 492 115 A1 | 1/1992 |
| FR | 2 576 962 A1 | 8/1986 |

* cited by examiner

*Primary Examiner*—Brian E. Glessner
*Assistant Examiner*—Christopher Boswell
(74) *Attorney, Agent, or Firm*—Marshall, Gerstein & Borun LLP

(57) ABSTRACT

A device for storing articles comprises boxes. Each box comprises an outer shell shell removably mounted on a support by interfitting engagement, and a moving portion connected to the outer shell. The device further comprises a lock adapted firstly to allow the moving portion to be opened and closed relative to the outer shell, and secondly to allow the outer shell of the box to be unlocked from the support.

11 Claims, 6 Drawing Sheets

FIG. 5
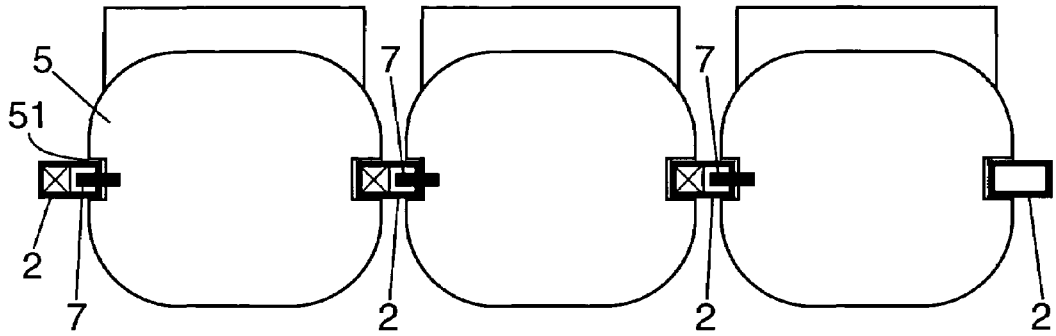
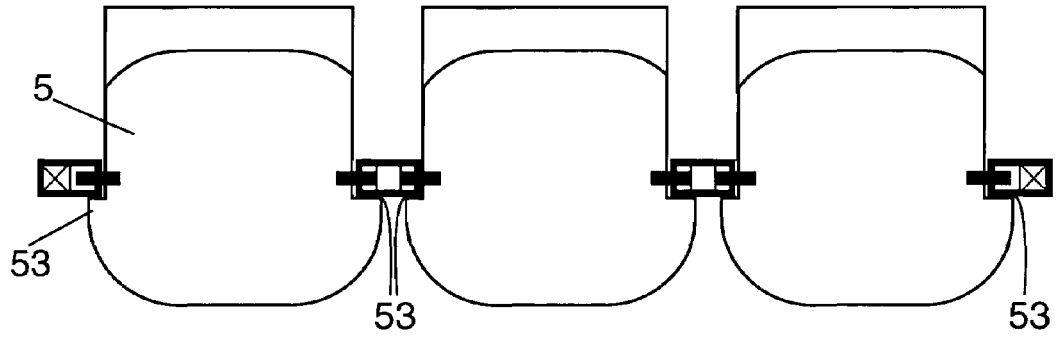
FIG. 6

DEVICE FOR STORING OBJECTS

The present invention relates to a device for storing articles, comprising at least one box for storing said articles.

BACKGROUND OF THE INVENTION

Devices are known for storing articles such as goods or documents, the devices comprising at least one box directly integrated on a support, itself intended to be fixed or placed on the ground. That type of box generally comprises an outer shell permanently secured to the support or else formed integrally with said support, and a moving portion mounted to move relative to the outer shell. The moving portion is generally mounted to move between an open position giving access to the inside of the box and a closed position in which said moving portion is secured to the outer shell, thus preventing access to the inside of the box.

Nevertheless, those known storage devices do not enable the box to be separated from the support, thereby preventing any replacement of the box by another box which is identical or similar.

SUMMARY OF THE INVENTION

An object of the invention is to provide a storage device in which the box can be mounted removably on the support by means that are simple, effective, and inexpensive.

For this purpose, according to the invention, a device of the kind in question for storing articles is essentially characterized in that the box comprises an outer shell that is removably mounted on a support by interfitting engagement, and a moving portion connected to the outer shell, said moving portion being movable between a open position giving access to the inside of the box and a closed position in which said moving portion is held to the outer shell to prevent access to the inside of the box, and in that the device includes at least one lock secured to the support or to the box, said lock being adapted firstly to allow the moving portion to be opened and closed relative to the outer shell, and secondly to allow the outer shell of the box to be unlocked relative to the support.

In preferred embodiments of the storage device of the invention, recourse is also had to one or more of the following dispositions:

- the lock is secured to the support, said lock having a bolt suitable for occupying at least one of the following positions:
  - a closing position in which the bolt of the electric lock fixes the moving portion of the box which is associated therewith to the outer shell;
  - an opening position in which the bolt of the electric lock releases the moving portion of the box from the outer shell of the box; and
  - an unlocking position in which the bolt of the electric lock releases the outer shell of the box with which it is associated from the support;
- the device includes at most N boxes and at least N locks;
- each lock is an electric lock, and the device further comprises a control system for selectively controlling the electric locks;
- the support comprises at least two substantially parallel beams, and the outer shell of each box has two grooves of shape complementary to the shape of the beams to enable boxes to be engaged and aligned on the two beams;

- the N electric locks are received in one of the two beams which has N openings through which the bolts of said locks can pass, the bolt of each electric lock being designed to co-operate with a through hole formed in the bottom of one of the two grooves in the outer shell of each box;
- a cross-member is mounted in releasable manner on the ends of the two beams to enable the boxes to be engaged thereon, said cross-member being secured to the ends of the beams by means of a lock;
- the support comprises two substantially parallel beams and N pairs of carrier elements, each carrier element being disposed substantially perpendicularly to the beam with which it is associated, and the outer shell of each box has at least two grooves of shape complementary to the shape of the carrier elements so as to enable each box to be engaged on at least one pair of carrier elements;
- the N electric locks are housed respectively in the N pairs of carrier elements, the bolt of each electric lock being designed to co-operate with a through hole formed in the bottom of one of the two grooves in the outer shell of each box; and
- the moving portion of each box presents an opening designed to be placed in register with the through hole of the outer shell when the moving portion is in its closed position, said opening receiving a portion of the bolt of the lock with which it is associated.

BRIEF DESCRIPTION OF DRAWINGS

Other characteristics and advantages of the invention appear from the following detailed description of a plurality of embodiments, given as non-limiting examples and with reference to the accompanying drawings, in which:

FIG. 5 is a section view of a storage device constituting a variant of the first embodiment;

FIG. 6 is a section view of a storage device constituting a second embodiment of the invention;

DESCRIPTION OF PREFERRED EMBODIMENTS

In the various figures, the same references are used to designate elements that are identical or similar.

Figure 1:
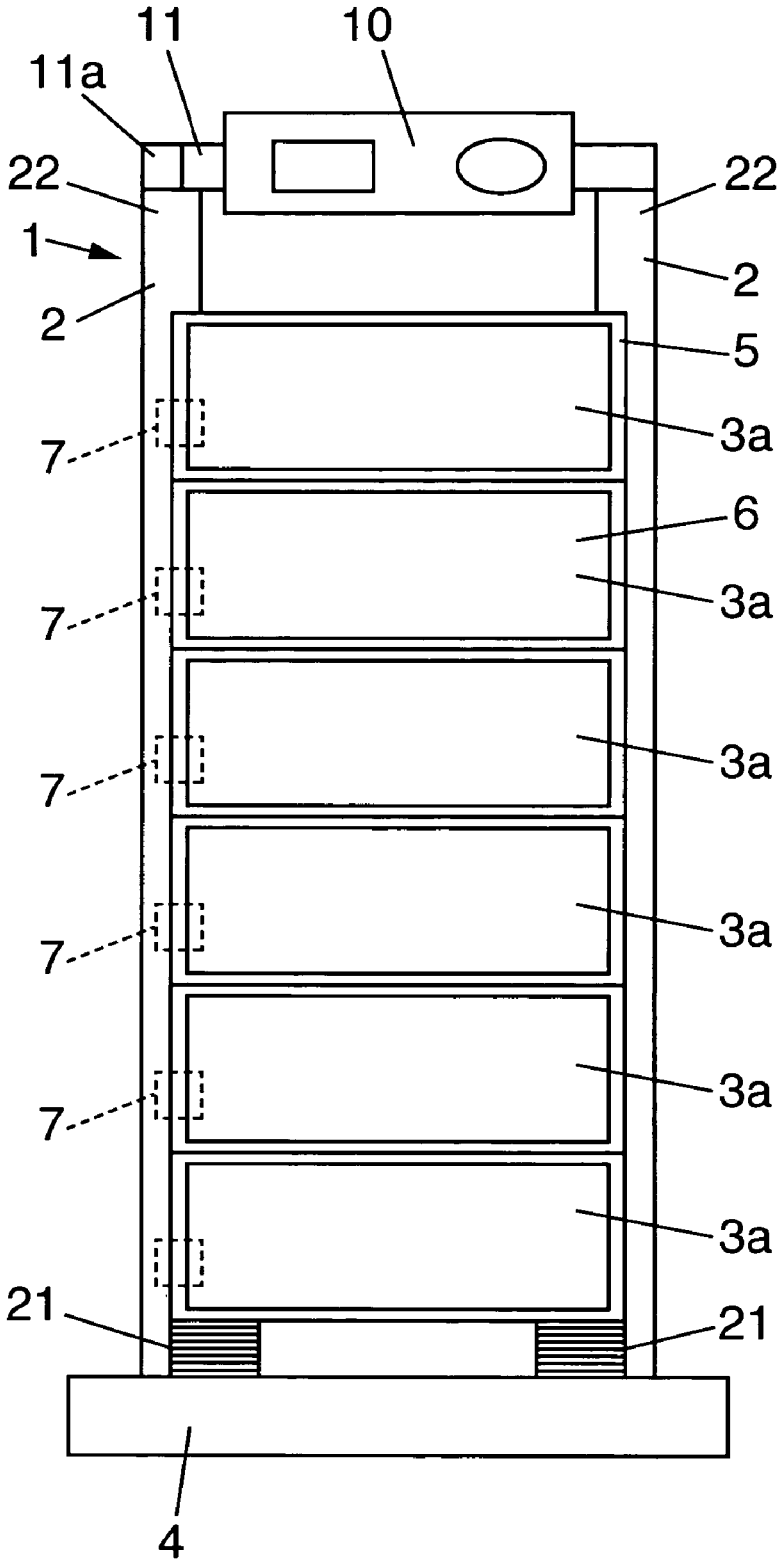
FIG. 1 is a diagrammatic front view of a storage device constituting a first embodiment of the invention.

The device for storing articles shown in FIG. 1 mainly comprises a support 1 comprising two parallel beams 2 which have a plurality of boxes 3*a*, in this case six boxes, mounted thereon by interfitting engagement. Each of the two beams 2 has a bottom end 21 fixed on a stand 4. The two beams also present top ends 22 via which the various boxes 3*a* are engaged.

Each box 3*a* comprises both an outer shell 5 which is removably mounted on the two beams 2 by interfitting engagement, and a moving portion 6 which is connected to the outer shell 5. The moving portion 6 is mounted to move between an open position giving access to the inside of the box and a closed position in which said moving portion 6 is held to the outer shell 5 to prevent access to the inside of the box. By way of example, the various boxes 3*a* may be in the form of drawers. Similarly, the outer shell may be substantially in the form of a rectangular parallelepiped while the moving portion is in the form of a sliding panel which is guided in rails made in the shell of the box.

The support 1, or more precisely one of its beams 2, also has a plurality of locks 7 directly housed in said beam.

In the example shown in FIG. 1, the storage device can have a maximum of six boxes 3*a*, and consequently the storage device includes a minimum of six locks 7, as can be seen in FIG. 1. The locks 7 are regularly spaced apart along the beam 2 and each lock is disposed approximately halfway up the box 3*a* which is associated therewith.

Figure 2:
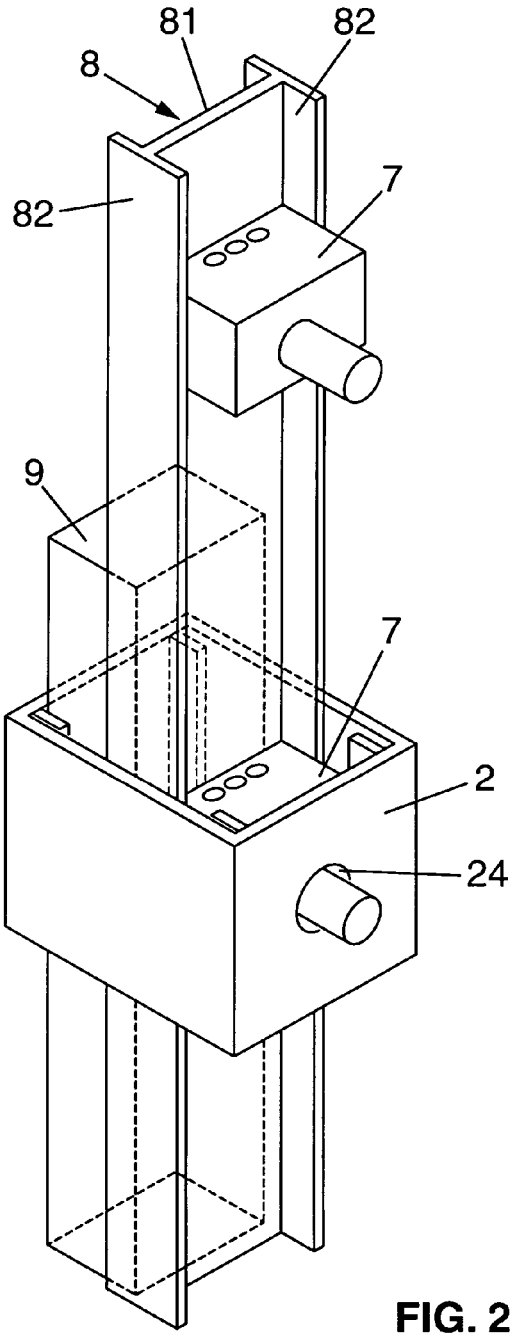
FIG. 2 is a fragmentary section view in perspective of a beam of a support of the first embodiment of the storage device.

FIG. 2 is a diagrammatic fragmentary section of the beam 2 and shows the disposition of the locks 7 inside the beam 2.

The hollow beam 2 for housing the locks 7 is of substantially rectangular section, for example. By way of example, the beam 2 can house a rail 8 extending along the full length of the beam 2 and having its bottom end (not shown) fixed to the stand 4.

Figure 3:
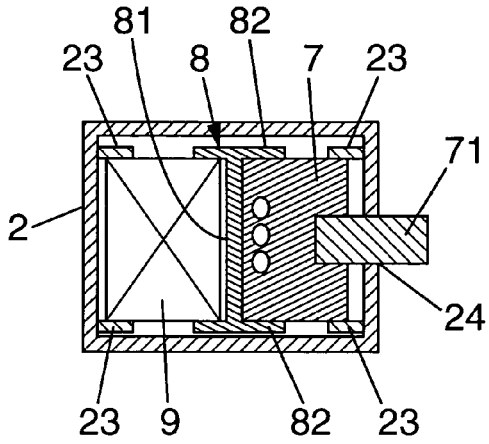
FIG. 3 is a section view of the beam of the storage device support.
Figure 4A:
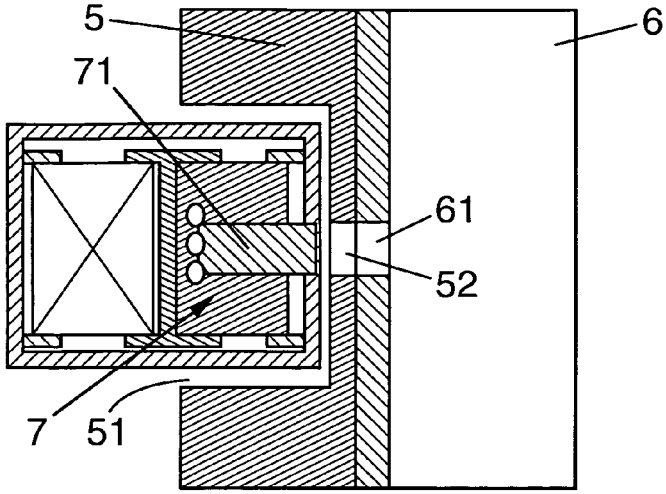
FIGS. 4*a*, 4*b*, and 4*c* are section views of an electric lock in three different positions.

As can be seen in FIG. 3, the rail 8 is of substantially I-section and it has flanges 82 interconnected by a web 81. A spacer element 9 is interposed between the flanges 82 of the rail 8 and splines 23 disposed on the inside wall of the beam 2. Similarly, each lock 7 is interposed between the two flanges 82 of the rail 8 and also bears against two supporting splines 23 placed against the inside wall of the beam 2. The electric locks 7 are regularly spaced apart over a fraction of the length of the rail 8 and have respective bolts 71 which pass through the beam 2 via respective holes 24. In order to enable the boxes 3*a* to engage between the two beams 2, each outer shell 5 of each box 3*a* has vertical grooves 51 in its side walls that are complementary in shape to the beams 2 (FIG. 4*a* and FIG. 5). Thus, in order to put the boxes 3*a* into place on the support 1, it suffices to engage the grooves 51 of the outer shell 5 of each box 3*a* with the top ends 22 of the two beams 2.

Figure 4B:
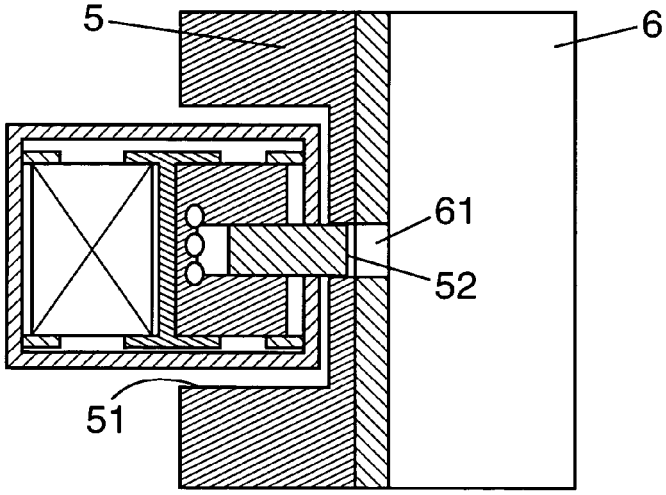
Figure 4C:
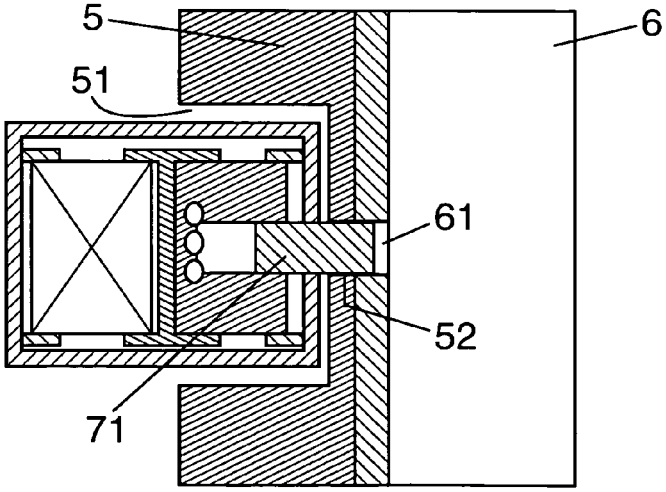

While the six boxes 3*a* are being mounted by engagement on the two beams 2, each electric lock 7 is in a so-called "unlocking" position as shown in FIG. 4*a*. In this unlocking position, the free end of the bolt 71 of each electric lock is received in the hole 24 of the associated beam 2. In this unlocking position, the box 3*a* situated adjacent to the stand 4 rests directly on the bottom ends 21 of the two beams, and the other boxes 3*a* are stacked on one another. As can be seen in FIGS. 4*a*, 4*b*, and 4*c*, the grooves 41 of the outer shell 5 are likewise provided with through holes 52, and the moving portion 6 of each box is also provided with a through hole or opening 61 for co-operating with the bolt of the associated locks, as described in greater detail below.

Furthermore, each lock 7 is connected by a wire connection (not shown) to a control system 10 which is also described in greater detail below.

Thus, when the bolts 71 of the electric locks 7 are in the unlocking position, the outer shell 5 of each box 3*a* is engaged on the beams 2 while being free to move towards the top ends 22 of the beams 2.

The control system 10 also selectively controls the electric box 7 so as to place the bolts 71 into a so-called "opening" position. In this opening position, each bolt 71 is inserted into the through hole 52 of the outer shell 5 of the associated box, but without co-operating with the through hole 61 in the moving portion 6 of the box. Thus, in this opening position, the moving portion 6 of each box can slide relative to its outer shell 5, thereby enabling a user to have access to the inside of the box, while the outer shell remains locked to the support 1.

Similarly, the control system 10 can cause the bolts of the electric locks to occupy a so-called "closing" position as shown in FIG. 4*c*.

In this closing position, each bolt 71 is inserted into the through hole or opening 61 of the moving portion 6, consequently holding it relative to the outer shell 5. In this closing position, the moving portion 6 and the outer shell 5 of each box are locked together to the beams 2 of the support 1, thereby preventing a user from having access to the inside of the box.

Advantageously, the control system 10 enables the electric locks 7 to be controlled selectively so as to place a lock associated with a box in an open, closed, or unlocked configuration without changing the configurations of the other electric locks associated with the other boxes.

The control system 10 can be designed to enable users to identify themselves so as to be able to receive a package disposed in one of the boxes 3*a*. Other such circumstances, a user can, for example, input a confidential code corresponding to the package by using a keypad (not shown). The confidential code can then be compared with a code contained in the control system in order to enable (or not enable) opening of the box in which the package has been put by an operator who reprogrammed the control system.

By way of example, the control system 10 may be disposed on a cross-member 11 mounted in releasable manner on the top ends 22 of the beam 2. For this purpose, the cross-member 11 may have one end pivotally mounted on the top end 22 of one of the beams while the other end of the cross-member 11 is secured to the top end 22 of the other beam 2 by means of an electric lock 11*a* a or a lock 11*a* having a key. Thus, in order to place the set of boxes 3*a* on the support 1, the cross-member 11 needs to be moved out of the way in order to release the space defined between the two beams 2, and then the set of boxes needs to be engaged, after which the free end of the cross-member 11 is returned to the top end 22 of the beams 2 associated therewith and the lock 11*a* is locked so as to ensure that the cross-member 11 is secured to the support 1.

Figure 8A:
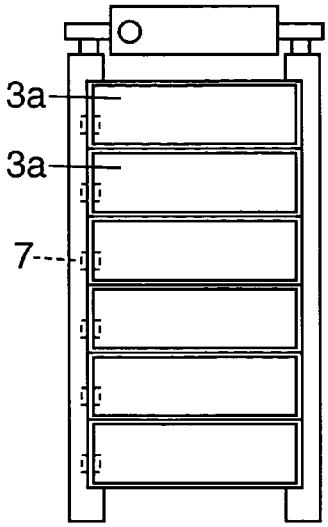
FIGS. 8*a* to 8*f* show the storage device in several possible configurations.

In one of the advantageous uses of the invention, as shown in FIGS. 8*a* to 8*f*, the storage device of the invention can be used with boxes of different sizes depending on the intended use. Thus, as shown in FIG. 8*a*, the storage device can include a maximum of six boxes, for example, in which case each electric lock is associated with a single box. In this case, the control system 10 selectively controls each electric lock 7 so as to allow a single box 3*a* to be opened, closed, or locked.

Figure 8B:
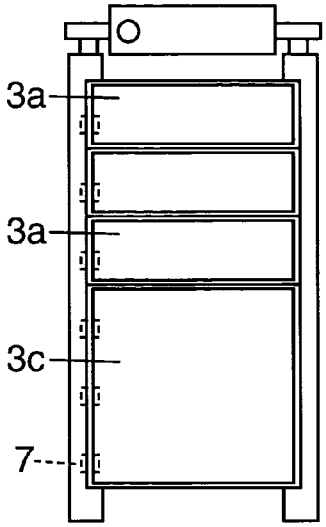

In another use of the storage device as shown in FIG. 8*b*, the storage device has only four boxes, including one box 3*c* of height substantially identical to the total height of three small-sized boxes 3*a*. In this case, the three locks for fixing the box 3*c* are operated simultaneously by the control device which is reprogrammed for this purpose.

Figure 8C:
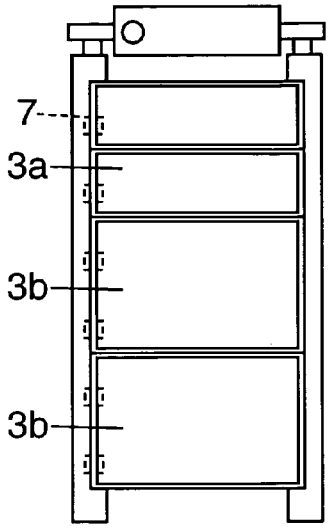

Similarly, in FIG. 8*c*, the storage device can have two boxes 3*a* of small size together with two boxes 3*b* of a different size. Each box 3*b* is of a height that is substantially identical to the total height of two small-sized boxes 3*a*. In this case, two locks are associated with each of the boxes 3*b* and the control system 10 is reprogrammed so that the two electric locks associated with any one box 3*b* are operated simultaneously.

Figure 8D:
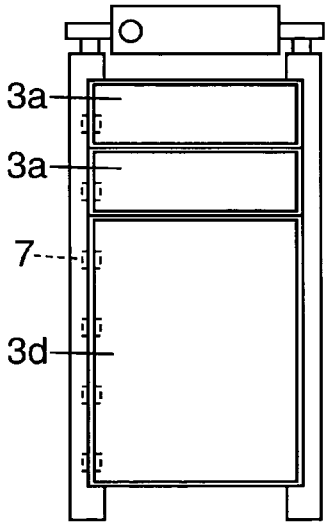

Similarly, in another use of the storage device, it can also include two small-sized boxes 3*a* and one box 3*d* as shown in FIG. 8*d*. The box 3*d* is of a height substantially equivalent to the total height of four small-sized boxes 3*a* and is correspondingly associated with four locks 7.

Figure 8E:
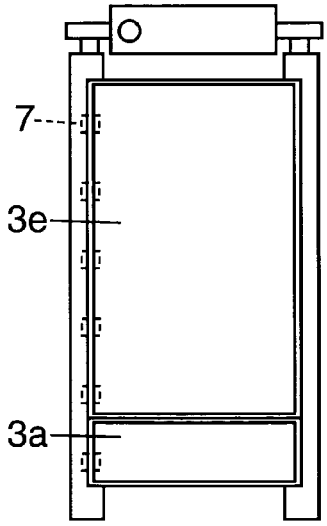
Figure 8F:
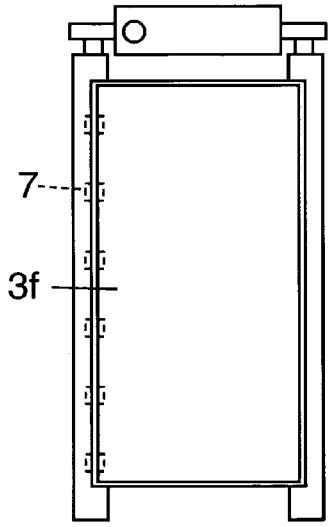

In another use of the storage device as shown in FIG. 8*e*, it may also include a single small-sized box 3*a* together with a box 3*e* associated with the other five locks which are operated simultaneously by the control system 10.

Finally, in another use of the storage device, the beams 2 may also support a single box 3*f* of large size, being of height that corresponds substantially to the total height of six small-sized boxes 3*a*, and in this case, once reprogrammed, the control system operates all six electric locks 7 simultaneously.

It will thus be understood that given that each lock is received directly in a beam 2, installing boxes 3*a* to 3*f* of different sizes, replacing them, and maintaining them, does not under any circumstances require the electric locks to be dismantled and they remain housed inside the beams.

In a variant embodiment shown in FIG. 5, the storage device comprises four beams 2 enabling three columns of boxes (which may be of different sizes) to be secured. In this case, three beams, for example, can fitted with electric locks 7 that are regularly distributed along the heights of said beams 2.

Figure 7:
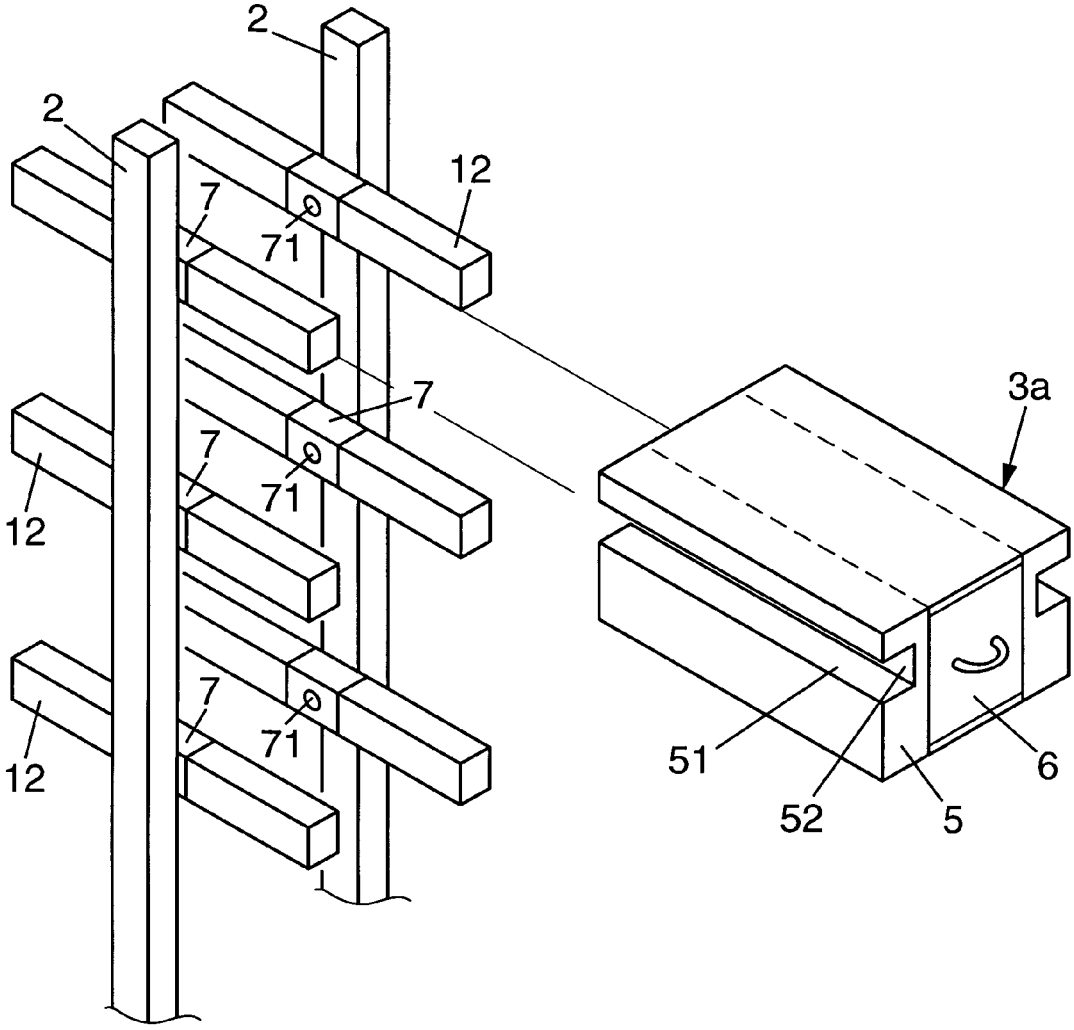
FIG. 7 is a diagrammatic perspective view of a third embodiment of the storage device of the invention.

In another embodiment of the invention as shown in FIG. 7, the outer shells 5 of the boxes are no longer provided with grooves, but instead they are provided with shoulders 53 designed to come into abutment against the beams 2 of the storage device.

The presence of the shoulders 53 makes it possible, advantageously, for the boxes to be engaged from in front of the beams 2, so there is no longer any need to engage the boxes via the top ends of said beams 2.

In this embodiment, it is also possible to fit each beam 2 disposed between two columns of boxes with two locks for co-operating with the boxes in two distinct columns.

In a variant embodiment that is not shown in the figures, the support 1, or more exactly the beams 2 of the support, could alternatively be disposed horizontally instead of being disposed vertically.

In another embodiment of the invention, shown in FIG. 7, the support comprises two substantially parallel beams 2 together with N pairs of carrier elements 12. Each carrier element 12 is disposed substantially perpendicularly relative to the associated beam 2. Thus, two carrier elements 12 forming a pair are disposed respectively on each of the two beams 2 and are also disposed facing each other so as to co-operate with a box 3*a*. In this embodiment, the outer shell 5 of each box has at least one horizontal groove in each of its side walls of shape complementary to the shape of the carrier element 12 so as to enable each box to be engaged on at least one pair of carrier elements.

Naturally, as mentioned above, two boxes 3*a* of small size may be replaced by a double box of height substantially equal to the height of two small-sized boxes. Under such circumstances, each of the side walls of the double box has two horizontal grooves for co-operating with two carrier elements 12 fitted to the same beam 2.

As can be seen in FIG. 7, the two grooves 51 in a single small-sized box 3*a* are provided with through holes 52 for co-operating with electric locks 7 placed inside the carrier element 12 of the two beams 2, which beams can be disposed horizontally or vertically, as shown in the figures.

The invention claimed is:

1. A device for storing articles comprising at least one box for storing said articles, the box comprising an outer shell that is removably mounted on a support by interfitting engagement, and a moving portion connected to the outer shell, said moving portion being movable relative to the outer shell between an open position giving access to the inside of the box and a closed position in which said moving portion is held to the outer shell to prevent access to the inside of the box, and the device including at least one electric lock secured to the support, said lock being adapted firstly to allow the moving portion to be opened and closed relative to the outer shell, and secondly to allow the outer shell of the box to be unlocked relative to the support, wherein the lock is secured to the support, said lock having a bolt controlled for selectively occupying at least one of the following positions:

a closing position in which the bolt of the electric lock fixes the moving portion of the box which is associated therewith to the outer shell, and said bolt fixes said outer shell to said support;

an opening position in which the bolt of the lock releases the moving portion of the box from the outer shell of the box, but still fixes said outer shell to said support; and an unlocking position in which the bolt of the lock releases the outer shell of the box with which it is associated from the support.

2. A device according to claim 1, including at most N boxes and at least N locks, N being an integer at least equal to 1.

3. A device according to claim 2, further comprising a control system for selectively controlling the electric locks.

4. A device according to claim 3, in which the support comprises at least two substantially parallel beams, and the outer shell of each box has two grooves of shape complementary to the shape of the beams to enable boxes to be engaged and aligned on the two beams.

5. A device according to claim 4, in which the N electric locks are received in one of the two beams which has N openings through which the bolts of said locks can pass, the bolt of each electric lock being designed to co-operate with a through hole formed in the bottom of one of the two grooves in the outer shell of each box.

6. A device according to claim 4, in which a cross-member is mounted in releasable manner on the ends of the two beams to enable the boxes to be engaged thereon, said cross-member being secured to the ends of the beams by means of a lock.

7. A device according to claim 5, in which the moving portion of each box presents an opening designed to be placed in register with the through hole of the outer shell when the moving portion is in its closed position, said opening receiving a portion of the bolt of the lock with which it is associated.

8. A device according to claim 3, in which the support comprises two substantially parallel beams and N pairs of carrier elements, each carrier element being disposed substantially perpendicularly to the beam with which it is associated, and the outer shell of each box has at least two grooves of shape complementary to the shape of the carrier elements so as to enable each box to be engaged on at least one pair of carrier elements.

9. A device according to claim 8, in which the N electric locks are housed respectively in the N pairs of carrier elements, the bolt of each electric lock being designed to co-operate with a through hole formed in the bottom of one of the two grooves in the outer shell of each box.

10. A device according to claim 1, wherein said bolt is slidingly mounted on said support.

11. A device according to any of the previous claims, wherein the moving portion is a drawer which is slidingly mounted in the outer shell.

* * * * *

UNITED STATES PATENT AND TRADEMARK OFFICE

CERTIFICATE OF CORRECTION

PATENT NO. : 7,028,621 B2
APPLICATION NO. : 10/479321
DATED : April 18, 2006
INVENTOR(S) : Antoine F. Pierre Mercier It is certified that error appears in the above-identified patent and that said Letters Patent is hereby corrected as shown below:

On the Title Page:

Item (75), Sole Inventor, please delete "Montmorenct" and insert -- Montmorency --.

Item (57), line 1, please delete "comprises" and insert -- comprising --.

Item (57), line 2, please delete "shell shell" and insert -- shell --.

Signed and Sealed this

Seventh Day of August, 2007

JON W. DUDAS
*Director of the United States Patent and Trademark Office*